US010234122B2

(12) United States Patent
Kawachi et al.

(10) Patent No.: US 10,234,122 B2
(45) Date of Patent: Mar. 19, 2019

(54) LIGHTING APPARATUS

(71) Applicant: PANASONIC INTELLECTUAL PROPERTY MANAGEMENT CO., LTD., Osaka (JP)

(72) Inventors: Hideharu Kawachi, Hyogo (JP); Yoshiyuki Nakano, Osaka (JP); Shinichi Kitaoka, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 83 days.

(21) Appl. No.: 15/453,349

(22) Filed: Mar. 8, 2017

(65) Prior Publication Data

US 2017/0261191 A1 Sep. 14, 2017

(30) Foreign Application Priority Data

Mar. 9, 2016 (JP) ..... 2016-046361

(51) Int. Cl.

| | |
|---|---|
| ***F21V 5/04*** | (2006.01) |
| ***F21V 9/08*** | (2018.01) |
| ***F21V 9/30*** | (2018.01) |
| ***F21V 11/00*** | (2015.01) |
| ***F21V 11/18*** | (2006.01) |

(Continued)

(52) U.S. Cl.

CPC ..... *F21V 25/02* (2013.01); *F21V 9/08* (2013.01); *F21V 11/00* (2013.01); *F21V 11/18* (2013.01); *F21V 11/186* (2013.01); *F21V 17/107* (2013.01); *F21V 5/04* (2013.01); *F21V 9/30* (2018.02); *F21V 13/12* (2013.01); *F21Y 2115/30* (2016.08)

(58) Field of Classification Search

CPC ..... F21V 11/00; F21V 11/18; F21V 11/186; F21V 13/12; F21V 17/107; F21V 25/02; F21V 5/04; F21V 9/08; F21V 9/30; F21Y 2115/30

See application file for complete search history.

(56) References Cited

U.S. PATENT DOCUMENTS

| | | | | |
|---|---|---|---|---|
| 9,173,039 | B2 * | 10/2015 | Iwamoto | H04R 23/008 |
| 2010/0254115 | A1 * | 10/2010 | Wegh | F21S 10/02 362/84 |

(Continued)

FOREIGN PATENT DOCUMENTS

| | | |
|---|---|---|
| JP | 2011-154995 | 8/2011 |
| JP | 2012-074620 | 4/2012 |

*Primary Examiner* — Tsion Tumebo

(74) *Attorney, Agent, or Firm* — Greenblum & Bernstein, P.L.C.

(57) ABSTRACT

A lighting apparatus including a base is provided. The base includes a through-hole. The through-hole is aligned with an optical path of laser light for receiving and transmitting the laser light. A light emitter which, when irradiated with the laser light transmitted through the through-hole, radiates light by converting a wavelength of the laser light. An attachment component is provided on the base for attachment of the light emitter to the base. The light emitter is removable from the base. A light blocker opens the optical path of the laser light by being contacted by the light emitter when the light emitter is attached to the base, and blocks the optical path of the laser light when the light emitter is removed from the base.

19 Claims, 10 Drawing Sheets

(51) Int. Cl.

| | |
|---|---|
| ***F21V 13/12*** | (2006.01) |
| ***F21V 17/10*** | (2006.01) |
| ***F21V 25/02*** | (2006.01) |
| ***F21Y 115/30*** | (2016.01) |

(56) References Cited

U.S. PATENT DOCUMENTS

| | | | | |
|---|---|---|---|---|
| 2010/0302467 | A1* | 12/2010 | Nagaharu | G03B 21/14 348/759 |
| 2011/0075117 | A1* | 3/2011 | Adachi | G03B 21/145 353/119 |
| 2011/0157865 | A1 | 6/2011 | Takahashi et al. | |
| 2012/0314442 | A1* | 12/2012 | Takahashi | F21S 41/14 362/538 |
| 2013/0306880 | A1* | 11/2013 | Yamano | A61B 1/0646 250/458.1 |
| 2014/0078717 | A1 | 3/2014 | Takahashi et al. | |
| 2014/0340918 | A1* | 11/2014 | Suckling | F21V 9/16 362/510 |
| 2015/0124224 | A1 | 5/2015 | Yamauchi et al. | |
| 2015/0252964 | A1* | 9/2015 | Takahashi | F21K 9/60 362/84 |
| 2016/0076736 | A1* | 3/2016 | Van Bommel | A61B 5/0071 435/29 |
| 2016/0084451 | A1* | 3/2016 | Annen | F21K 9/52 362/553 |

* cited by examiner

LIGHTING APPARATUS

CROSS REFERENCE TO RELATED APPLICATION

This application claims the benefit of priority of Japanese Patent Application Number 2016-046361 filed on Mar. 9, 2016, the entire content of which is hereby incorporated by reference.

BACKGROUND

1. Technical Field

The present disclosure relates to a lighting apparatus which uses laser light as a light source.

2. Description of the Related Art

Conventionally, there are lighting apparatuses which include a light emitter containing phosphors that emit light, with laser light transmitted by an optical fiber as excitation light, and illuminate by converting the laser light into light of a desired color. Since the laser light that is used as excitation light has a high energy density, from a safety viewpoint, techniques for avoiding direct entry of the laser light into human eyes are needed.

For example, Japanese Unexamined Patent Application Publication No. 2011-154995 (Patent Literature 1) describes a technique in which a light-dispersing material containing minute particles of silicon oxide or titanium oxide in a dispersed manner is placed, with respect to the light emitter, on the side which is opposite the side that is irradiated with laser light, to reduce the coherence of the laser light in the event that the light emitter cracks or falls off, etc.

SUMMARY

As in the technique disclosed in aforementioned Patent Literature 1, conventionally, there are techniques for preventing laser light from directly entering the eyes.

Meanwhile, lighting apparatuses that have a replacement function are being newly developed. The replacement function enables a light emitter that is already attached to the lighting apparatus to be removed and replaced with a new light emitter, such as when a damaged light emitter is to be replaced with a new light emitter or when an existing light emitter is to be replaced with a light emitter that emits a different color of light. In addition, during this development stage, a technique for protecting the eyes from laser light even during the light emitter replacement operation was found.

Specifically, the present disclosure provides a lighting apparatus, having laser light as a light source, which is capable of protecting an eye from unintentional leakage of laser light during light emitter replacement.

A lighting apparatus according to an aspect of the present disclosure is a lighting apparatus including a light emitter which, when irradiated with laser light, radiates light by converting a wavelength of the laser light, the light emitter being replaceable, the lighting apparatus including: a base; an attachment component provided on the base for attachment of the light emitter; and a light blocker which opens an optical path of the laser light by engaging with the light emitter that is attached to the base, and blocks the optical path of the laser light when the light emitter is removed from the base.

According to the light apparatus according to an aspect of the present disclosure, the light blocker surely blocks the optical path of the laser light when the light emitter is removed, and thus it is possible to prevent the laser light from unintentionally entering an eye during light emitter replacement.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

Hereinafter, a lighting apparatus according to an exemplary embodiment of the present disclosure will be described using the drawings. It should be noted that the subsequently-described exemplary embodiment shows a specific example. Therefore, numerical values, shapes, materials, structural components, the arrangement and connection of the structural components, etc. shown in the following embodiment are mere examples, and are not intended to limit the scope of the present disclosure. Furthermore, among the structural components in the following exemplary embodiment, components not recited in any one of the independent claims which indicate the broadest concepts of the present disclosure are described as arbitrary structural components.

Furthermore, the respective figures are schematic diagrams and are not necessarily precise illustrations. In addition, in the respective diagrams, identical structural components are given the same reference signs.

An exemplary embodiment is described below.

[Configuration of Lighting Apparatus]

Figure 1:
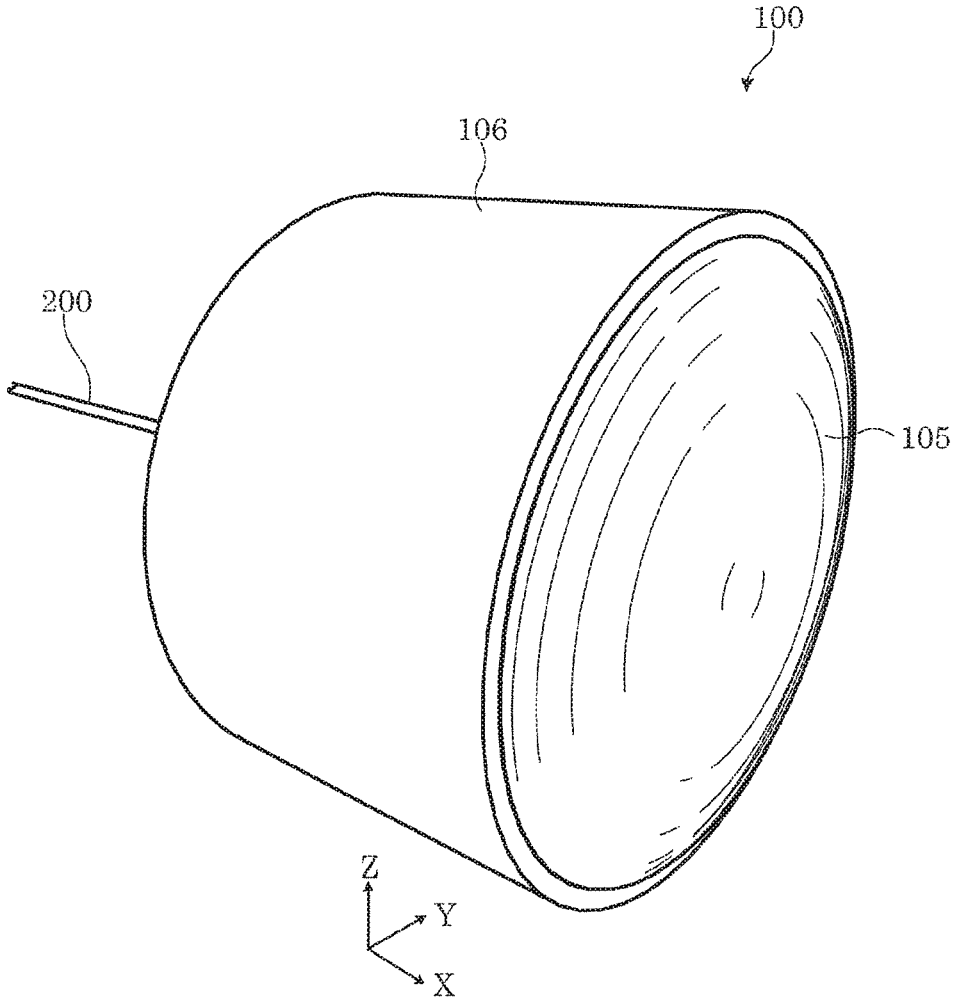
FIG. 1 is a perspective view of the external appearance of a lighting apparatus according to an embodiment.

FIG. 1 is a perspective view of the external appearance of a lighting apparatus according to this embodiment.

Figure 2:
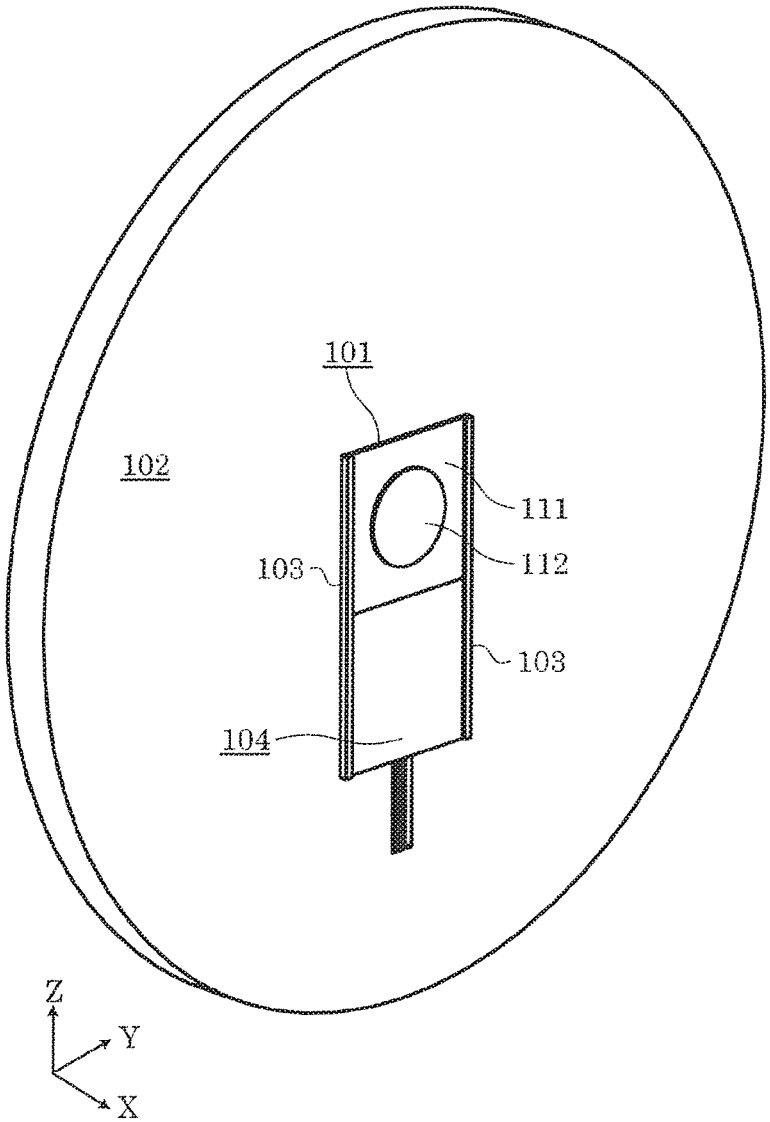
FIG. 2 is a perspective view of the vicinity of a light emitter according to the embodiment.

FIG. 2 is a perspective view of the vicinity of a light emitter according to this embodiment.

Figure 3:
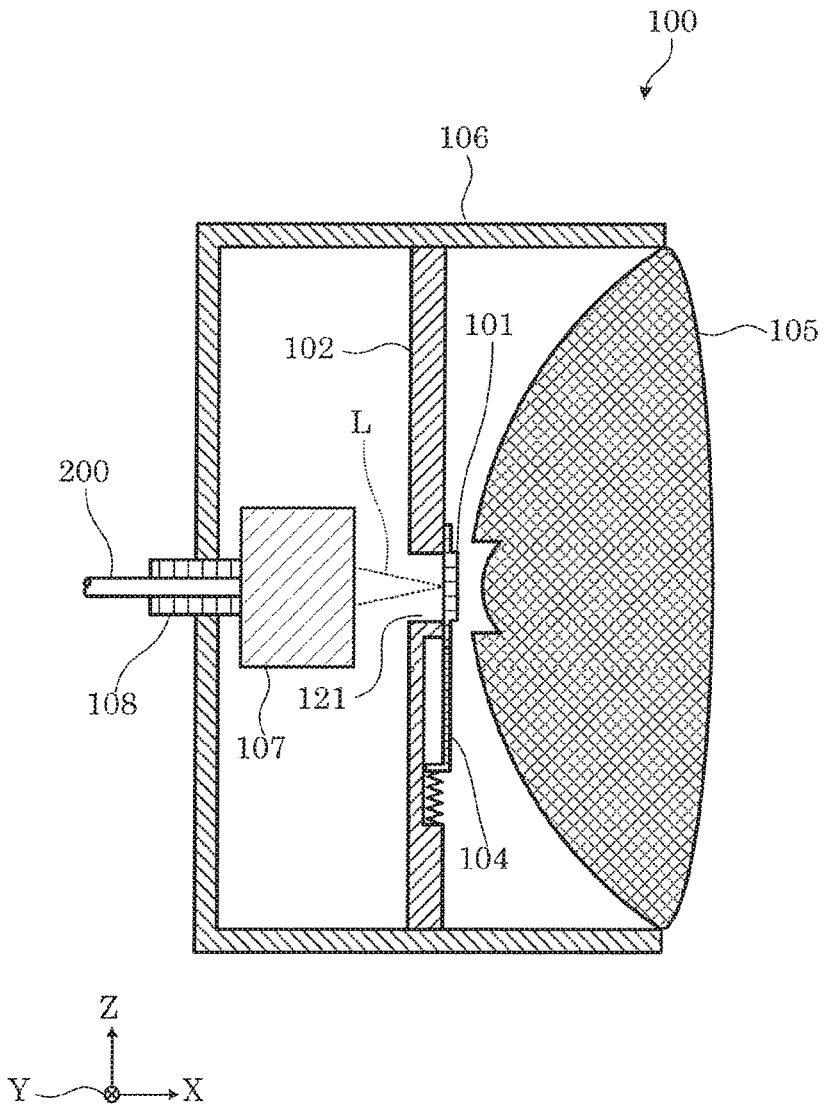
FIG. 3 is a cross-sectional view of the lighting apparatus according to the embodiment.

FIG. 3 is a cross-sectional view of the lighting apparatus according to this embodiment.

As illustrated in these figures, light apparatus 100 is an apparatus that emits visible light, with laser light L as a light source, and includes light emitter 101, base 102, attachment components 103, and light blocker 104. In this embodiment, lighting apparatus 100 further includes lens 105, case 106, optical system 107, and fiber attaching component 108.

As illustrated in FIG. 3, light emitter 101, when irradiated with laser light L, is capable of radiating light of a different wavelength from laser light L. In this embodiment, light emitter 101 includes board 111 and converter 112.

Board 111 is a structural component for holding converter 112, and is a transparent component capable of transmitting laser light L. Specifically, board 111 is, for example, a sapphire glass board, etc. In this embodiment, in the portion of board 111 in which converter 112 is not provided, a shielding film or a shielding structure is provided so that laser light L is not transmitted.

Converter 112 includes, in a dispersed state, phosphor particles which generate fluorescence when excited by laser light L, and irradiation with laser light L causes the phosphors to generate fluorescence that is of a different wavelength from laser light L.

Specifically, converter 112 can be exemplified as a component in which phosphor particles are dispersed inside a base material comprising a transparent resin or glass, or a component in which phosphor particles are packed tightly together. In other words, converter 112 includes a wavelength converting substance which converts laser light into fluorescence.

In this embodiment, converter 112 radiates white light as illuminating light, and includes, as the wavelength converting substance, plural types of phosphors which emit light of a different color when irradiated with laser light L.

Although there is no particular limitation on the type or characteristics of the wavelength converting substance, the phosphors have, for example, high heat resistance since laser light L, which has a comparatively high output, serves as the excitation light.

Furthermore, although there is no particular limitation on the type of the base material holding the wavelength converting substance in the dispersed state, the material has, for example, high transparency since higher transparency enhances radiation efficiency of white light. Furthermore, the base material has, for example, high heat resistance since laser light L, which has comparatively high output, is incident thereon.

Furthermore, converter 112 may include a function film for efficiently irradiating the phosphors with laser light L, a function film for efficiently radiating emitted visible light, etc.

Base 102 is a foundation-like structural component which holds light emitter 101 at a predetermined position. In this embodiment, base 102 is a disk-shaped component, and through-hole 121 for transmitting laser light L is provided at the center. Furthermore, the outer circumferential portion of base 102 is fixed to the inner circumferential portion of case 106.

Figure 4:
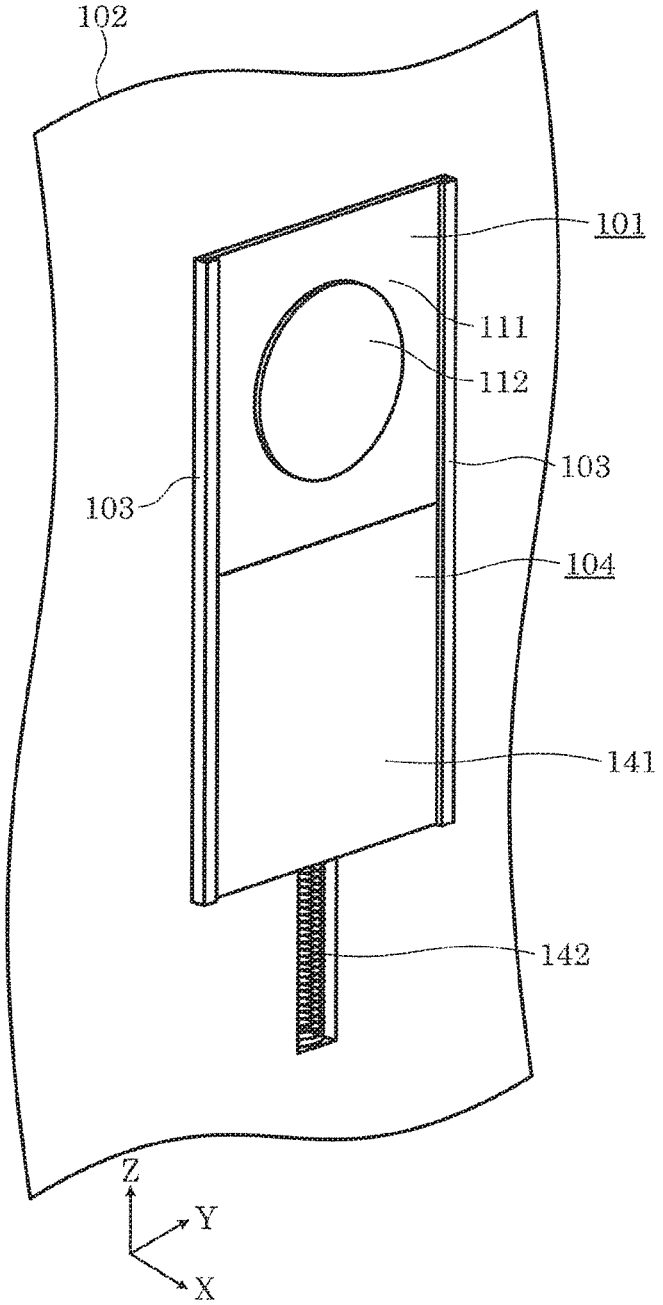
FIG. 4 is a perspective view of the vicinity of attachment components according to the embodiment.

FIG. 4 is a perspective view of the vicinity of attachment components.

Figure 5:
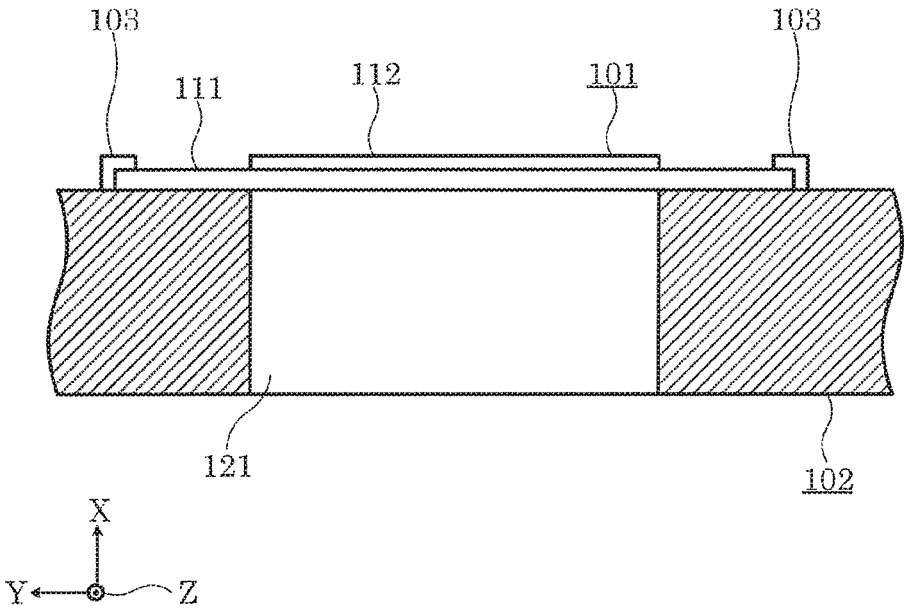
FIG. 5 is a top view of a partial cross-section of the vicinity of the attachment components according to the embodiment.

FIG. 5 is a top view of the vicinity of attachment components.

As illustrated in those figures, attachment components 103 are structural components which are provided in base 102, and enable light emitter 101 to be freely attachable to and removable from base 102. In this embodiment, attachment components 103 are provided opposed to each other at a distance corresponding to the width of board 111 of light emitter 101, and each runs along the sliding direction (Z-axis direction in the figure) of light emitter 101, and has an L-shaped cross-section perpendicular to the running direction, to form, together with base 102, grooves for sandwiching board 111 of light emitter 101.

Light blocker 104 is a mechanism that opens the optical path of laser light L when light emitter 101 is attached to base 102, and blocks the optical path of laser light L when light emitter 101 is removed from base 102.

In this embodiment, light blocker 104 includes blocking component 141 which blocks the optical path of laser light L and biasing component 142 which applies a force to blocking component 141.

In this embodiment, blocking component 141 is a board-shaped component comprising a material that does not transmit laser light L, and having the same shape as board 111 of light emitter 101 in a plan view (YZ plane in the figure). Furthermore, blocking component 141 is attached to attachment components 103 so as to be slidable with respect to base 102, in the same manner as light emitter 101.

Biasing component 142 is a component that applies force in the sliding direction (Z-axis direction in the figure) to blocking component 141. Biasing component 142, though not particularly limited, can be exemplified by a spring or rubber. In this embodiment, a coiled spring is used as biasing component 142.

As illustrated in FIG. 1 and FIG. 3, lens 105 is a component which is disposed, with respect to light emitter 101, on a side that is opposite the side that is irradiated with laser light L (in this embodiment, the side on which optical system 107 is disposed), and has a light distribution controlling structure which controls the distribution of light radiated by light emitter 101. In this embodiment, lens 105 is attached to case 106.

Although, as long as light radiated from light emitter 101 is transmitted, there is no particular limitation to the material of lens 105, the material, for example, allows easy forming of the light distribution controlling structure. A resin material such as acrylic or polycarbonate or a glass material, etc. can be given as an example of a material of lens 105.

As illustrated in FIG. 1 and FIG. 3, case 106 is a box-like structural component which houses light emitter 101 and optical system 107, and has lens 105 attached to one end and fiber attaching component 108 attached to the other end.

In this embodiment, case 106 is a cylindrical component and covers the optical path of laser light L. A component or structure which absorbs laser light L is provided on the inner circumferential surface of case 106 (illustration omitted).

Here, a component that absorbs laser light is, for example, a component which includes a pigment that absorbs blue color when the laser light is blue, for example. Furthermore, a structure that absorbs laser light is a structure, etc., that causes irregular reflection and quenching of laser light by having fine irregularities on the inner circumferential surface. Accordingly, the safety of lighting apparatus 100 can be maintained at a high state even when the optical axis of laser light L shifts unintentionally.

Optical system 107 is a set of lenses which are set to condense incident laser light L onto light emitter 101.

It should be noted that the type of optical system 107 is selected as appropriate in accordance with the intended use of lighting apparatus 100, and there are instances when lighting apparatus 100 does not include optical system 107.

Fiber attaching component 108 is a component for attaching optical fiber 200 to case 106 in such a way that optical fiber 200 is aligned with a predetermined optical axis. Optical fiber 200 transmits the laser light emitted from a light source apparatus which is a separate body from lighting apparatus 100. Fiber attaching component 108 enables optical fiber 200 to be attached so that the optical axis of laser light L passes through converter 112 of light emitter 101.

[Light Emitter Replacement Operation]

Next, the replacement operation of light emitter 101 will be described.

Figure 6:
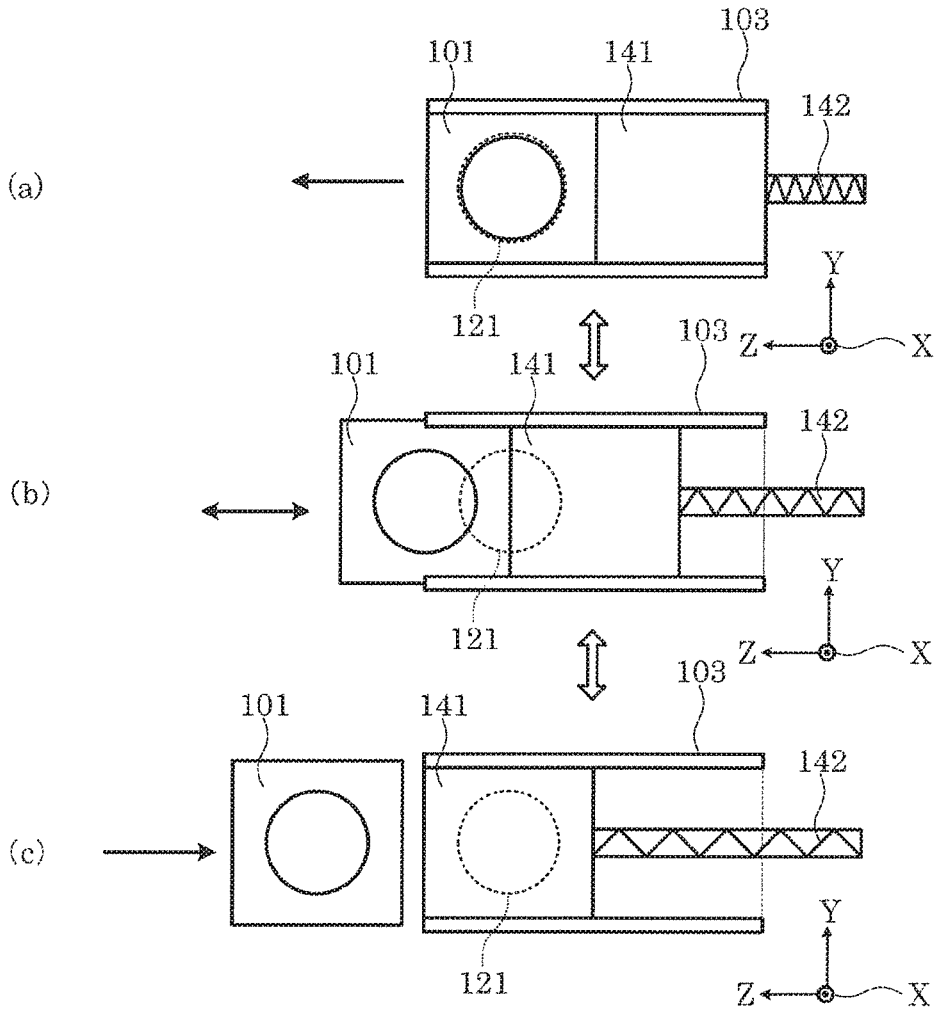
FIG. 6 is a diagram for describing in stages a light emitter replacement operation according to the embodiment.

FIG. 6 is a diagram for describing in stages a light emitter replacement operation.

As in stage (a) in the figure, in the state where light emitter 101 is attached to attachment components 103 to cover through-hole 121 which forms the optical path of laser light L, blocking component 141 is positioned at an opening position where the optical path (through-hole 121) is opened. In this embodiment, board 111 of light emitter 101 and blocking component 141 have the same shape, and blocking component 141 is slidably disposed adjacent to board 111. Furthermore, blocking component 141 is being forced toward through hole 121 by light emitter 101.

Next, as in stage (b) in the figure, when light emitter 101 is slid in order to replace light emitter 101, blocking component 141 is pushed by biasing component 142 and slides together with light emitter 101. As a result, while light emitter 101 is being slid, through-hole 121 which is the optical path of laser light L is blocked by light emitter 101 or blocking component 141, and thus laser light L does not leak outside.

Next, as in stage (c) in the figure, in the state where light emitter 101 is removed from attachment components 103, blocking component 141 is pushed out further by biasing component 141 so as to be positioned at a blocking position where blocking component 141 covers and blocks through-hole 121.

Accordingly, in the process in which light emitter 101 is to be removed from attachment components 103, light emitter 101 can be safely removed without opening the optical path of laser light L.

On the other hand, when attaching light emitter 101 to attachment components 103, sliding light emitter 101 in the order of (c), (b), (a) which is the reverse of the order stated above, positions light emitter 101 at a position where laser light L is irradiated, and blocking component 141, which is pushed by light emitter 101, slides up to a predetermined position while causing biasing component 142 to contract. In this manner, even when light emitter 101 is being attached, through-hole 121 which is the optical path of laser light L is always blocked by board 111 or blocking component 141.

As described above, with the configuration according to this embodiment, light emitter 101 can be replaced without opening through-hole 121 which is the optical path of laser light L, and thus it is possible to prevent laser light L from unintentionally entering an eye during the replacement operation, and replace light emitter 101 safely.

(Modification 1)

Next, a modification of light blocker 104 of lighting apparatus 100 will be described. It should be noted that the same reference sign is given to components (portions) having the same operation, function, shape, mechanism, or structure as in the foregoing embodiment, and their description may be omitted.

Figure 7:
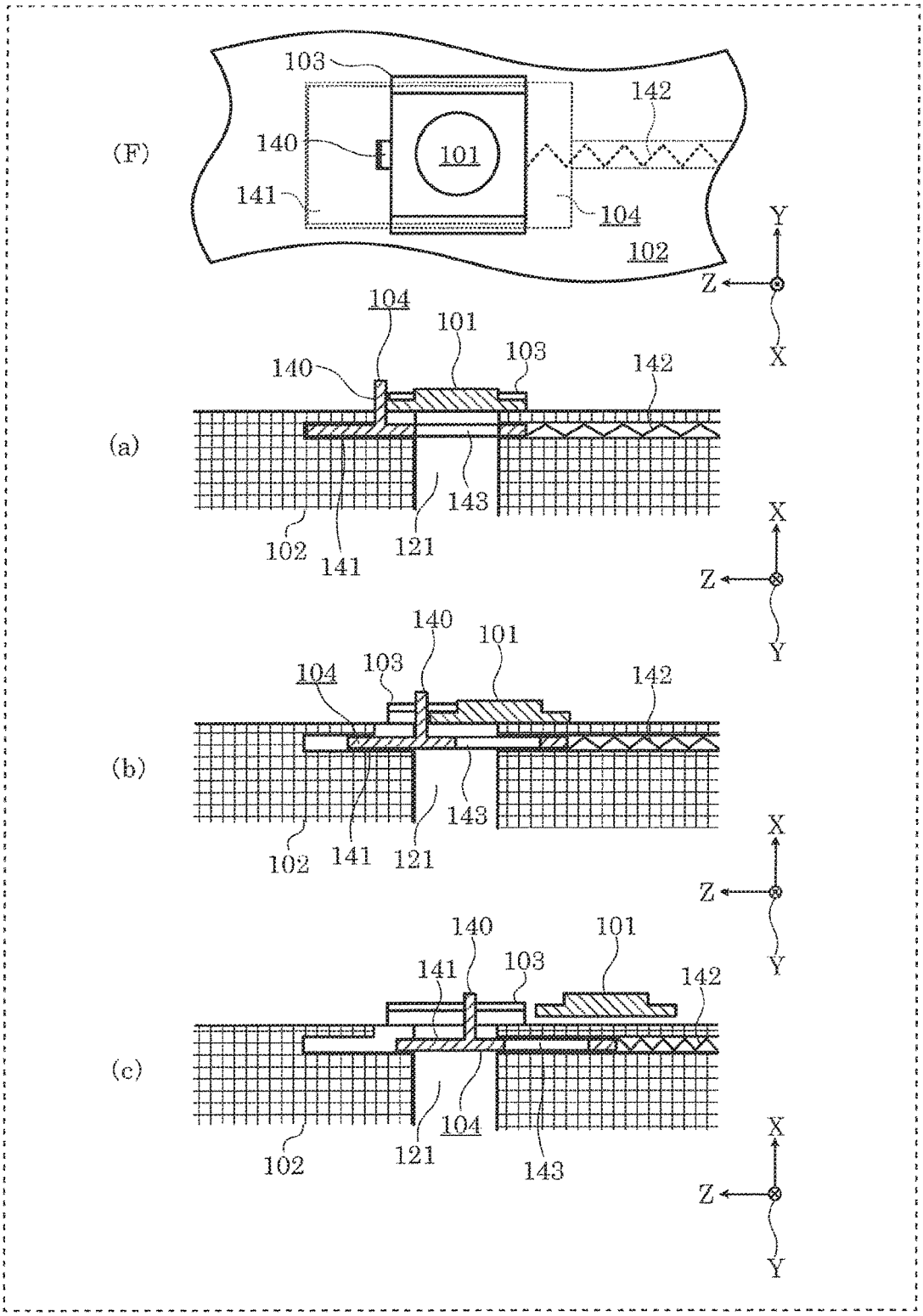
FIG. 7 is a diagram for describing in stages a light emitter replacement operation according to Modification 1.

FIG. 7 is a diagram for describing in stages a light emitter replacement operation in Modification 1. It should be noted that stage (F) in FIG. 7 is a plan view of the vicinity of light emitter 101, and stages (a), (b), and (c) in FIG. 7 are cross-sectional views of the vicinity of light emitter 101 from the side.

As illustrated in the figure, light blocker 104 includes blocking component 141 and biasing component 142, and transmitting hole 143 which has the same diameter as through-hole 121 provided in base 102 is provided in light blocker 104. Furthermore, blocking component 141 is disposed further on a laser light incidence side (negative side in the X-axis direction in the figure) than light emitter 101 is, and is slidably held by base 102. Furthermore, blocking component 141 includes lever 140 which extends from the center portion of blocking component 141 and protrudes up beyond the surface of base 102. Biasing component 142 applies force in a pulling direction onto blocking component 141.

[Light Emitter Replacement Operation]

Next, the replacement operation of light emitter 101 will be described.

As in stage (a) in FIG. 7, in the state where light emitter 100 is attached to attachment components 103 to cover through-hole 121 which forms the optical path of laser light L, light emitter 101 engages with lever 140 of light blocker 104, and is held in a state where transmission hole 143 of blocking component 141 and through-hole 121 of base 102 align. Therefore, blocking component 141 opens the optical path of laser light L (through-hole 121).

Next, as in stage (b) in FIG. 7, when light-emitter 101 is slid in order to replace light-emitter 101, blocking component 141 is pulled by biasing component 142 and slides together with light-emitter 101. As a result, while light-emitter 101 is being slid, through-hole 121 which is the optical path of laser light L is blocked by blocking component 141, and thus laser light L does not leak outside.

Next, as in (c) in FIG. 7, in the state where light emitter 101 is not attached to base 102, biasing component 142 pulls blocking component 141 so that blocking component 141 covers and blocks through-hole 141.

Accordingly, in the process in which light-emitter 101 is to be removed from attachment components 103, light-emitter 101 can be safely removed without opening the optical path of laser light L. Furthermore, in the case of Modification 2, since the portion of board 111 in which converter 112 of light emitter 101 is not attached is covered by blocking component 141, laser light L is not radiated to the outside even if such portion of board 111 is transparent with respect to laser light L, and thus safety can be ensured.

On the other hand, when attaching light emitter 101 to attachment components 103, sliding light emitter 101 in the order of (c), (b), and (a) which is the reverse of the order stated above, enables light emitter 101 to be attached to base 102. In the state where light emitter 101 is attached, transmission hole 143 of blocking component 141 is aligned with through-hole 121 which is the optical path of laser light L, and thus converter 112 of light emitter 101 is irradiated with laser light L.

Accordingly, light emitter 101 can be replaced safely without opening though-hole 121, which is the optical path of laser light L, during the replacement operation of light emitter 101.

(Modification 2)

Next, another modification of light blocker 104 of lighting apparatus 100 will be described. It should be noted that the same reference sign is given to components (portions) having the same operation, function, shape, mechanism, or structure as in the foregoing embodiment and Modification 1, and their description may be omitted.

Figure 8:
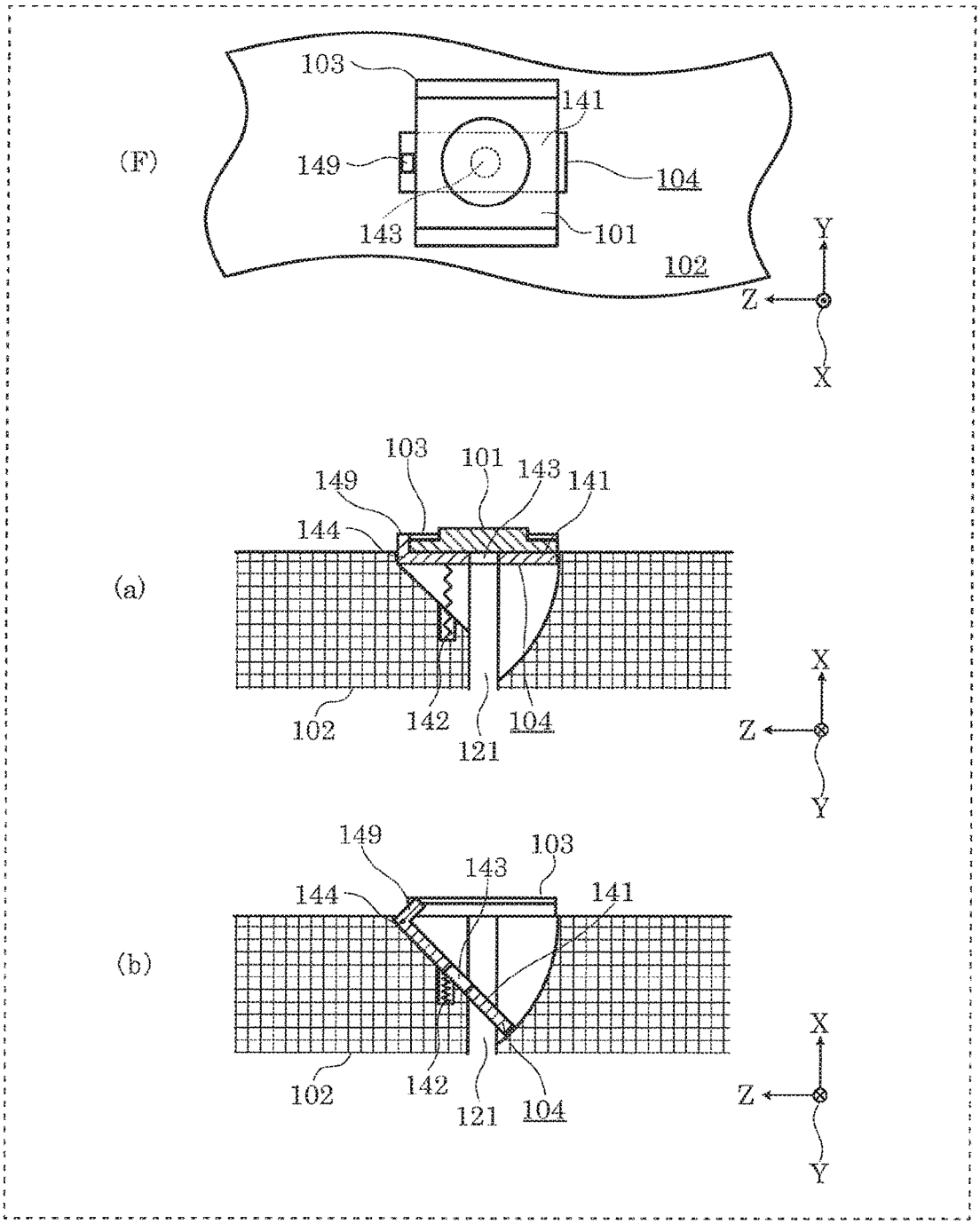
FIG. 8 is a diagram for describing in stages a light emitter replacement operation according to Modification 2.

FIG. 8 is a diagram for describing in stages a light-emitter replacement operation in Modification 2. It should be noted that stage (F) in FIG. 8 is a plan view of the vicinity of light-emitter 101, and stages (a) and (b) in FIG. 8 are cross-sectional views of the vicinity of light-emitter 101 from the side.

As illustrated in the figure, light blocker 104 includes blocking component 141, biasing component 142, and engaging component 149. Furthermore, light blocker 104 includes transmission hole 143 having the same diameter as through-hole 121 provided in base 102, and blocking component 141 is rotatably attached to base 102 by hinge 144. Biasing component 142 applies force in a pulling direction onto blocking component 141.

[Light-Emitter Replacement Operation]

Next, the replacement operation of light-emitter 101 will be described.

As in stage (a) in FIG. 8, in the state where light emitter 101 is attached to attachment components 103 to cover through-hole 121 which forms the optical path of laser light L, light emitter 101 and engaging component 149 of light blocker 104 engage, and blocking component 141 rotates until parallel with the surface of base 102. Accordingly, through-hole 121 of base 102 and transmission hole 143 align, which places the optical path of laser light L in the open state.

Next, as in stage (b) in FIG. 8, in the state where light emitter 101 is removed from attachment components 103 of base 102, blocking component 141 is pulled by biasing component 142 and rotates with respect to base 102 so as to be positioned in a blocking position where through-hole 121 is covered.

Accordingly, in the process in which light-emitter 101 is to be removed from attachment components 103, light-emitter 101 can be safely removed without opening the optical path of laser light L. On the other hand even when attaching light emitter 101 to attachment components 103 in the order of (b) then (a) which is the reverse of the order stated above, light emitter 101 can be safely attached without opening through-hole 121.

(Modification 3)

Next, another modification of light blocker 104 of lighting apparatus 100 will be described. It should be noted that the same reference sign is given to components (portions) having the same operation, function, shape, mechanism, or structure as in the foregoing embodiment and Modifications 1 and 2, and their description may be omitted.

Figure 9:
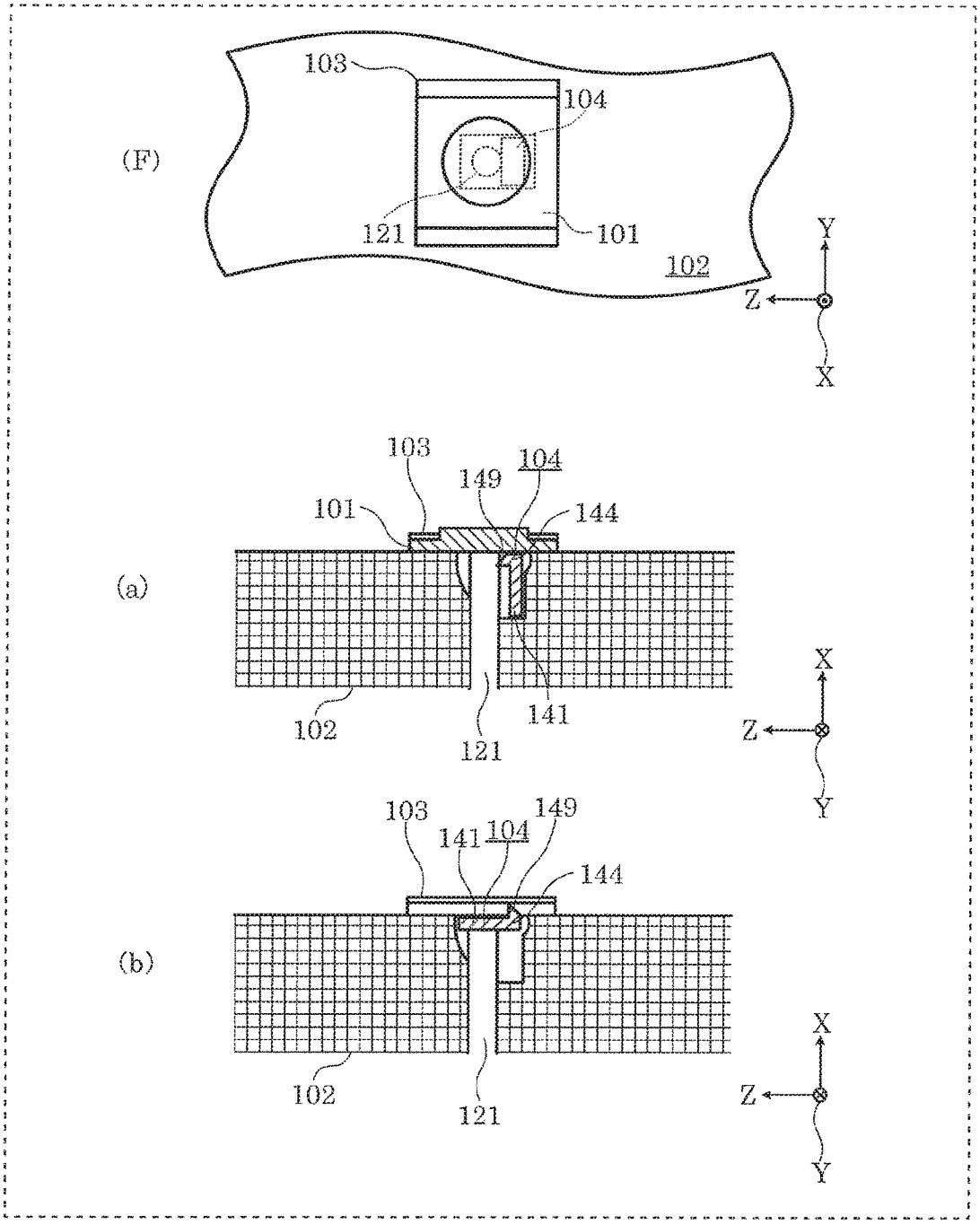
FIG. 9 is a diagram for describing in stages a light emitter replacement operation according to Modification 3.

FIG. 9 is a diagram for describing in stages a light-emitter replacement operation in Modification 3. It should be noted that stage (F) in FIG. 9 is a plan view of the vicinity of light-emitter 101, and stages (a) and (b) in FIG. 9 are cross-sectional views of the vicinity of light-emitter 101 from the side.

As illustrated in the figure, light blocker 104 includes blocking component 141, a biasing component (not illustrated), and engaging component 149. Furthermore, blocking component 141 is rotatably attached to base 102 by hinge 144. The biasing component is a spiral spring, and applies such a force that blocking component 141 becomes parallel to the surface of base 102.

[Light-Emitter Replacement Operation]

Next, the replacement operation of light-emitter 101 will be described.

As in stage (a) in FIG. 9, in the state where light emitter 101 is attached to attachment components 103 to cover through-hole 121 which forms the optical path of laser light L, light emitter 101 and engaging component 149 of light blocker 104 engage, and blocking component 141 rotates until through-hole 121 is opened and blocking component 141 is hanging down. Accordingly, the optical path of laser light L is opened.

Next, as in stage (b) in FIG. 9, in the state where light emitter 101 is not attached to attachment components 103 of base 102, blocking component 141 rotates due to biasing component 142 so as to be positioned in a blocking position where through-hole 121 is covered.

Accordingly, in the process in which light-emitter 101 is to be removed from attachment components 103, light-emitter 101 can be safely removed without opening the optical path of laser light L. On the other hand even when attaching light emitter 101 to attachment components 103 in the order of (b) then (a) which is the reverse of the order stated above, light emitter 101 can be safely attached without opening through-hole 121.

It should be noted that, in this embodiment, the replacement operation of light emitter 101 is performed, not by sliding light emitter 101 with respect to the surface of base 102 but by moving light emitter 101 along the axis of through-hole 121, (Modification 4)

Next, another modification of light blocker 104 of lighting apparatus 100 will be described. It should be noted that the same reference sign is given to components (portions) having the same operation, function, shape, mechanism, or structure as in the foregoing embodiment and Modifications 1, 2, and 3, and their description may be omitted.

Figure 10:
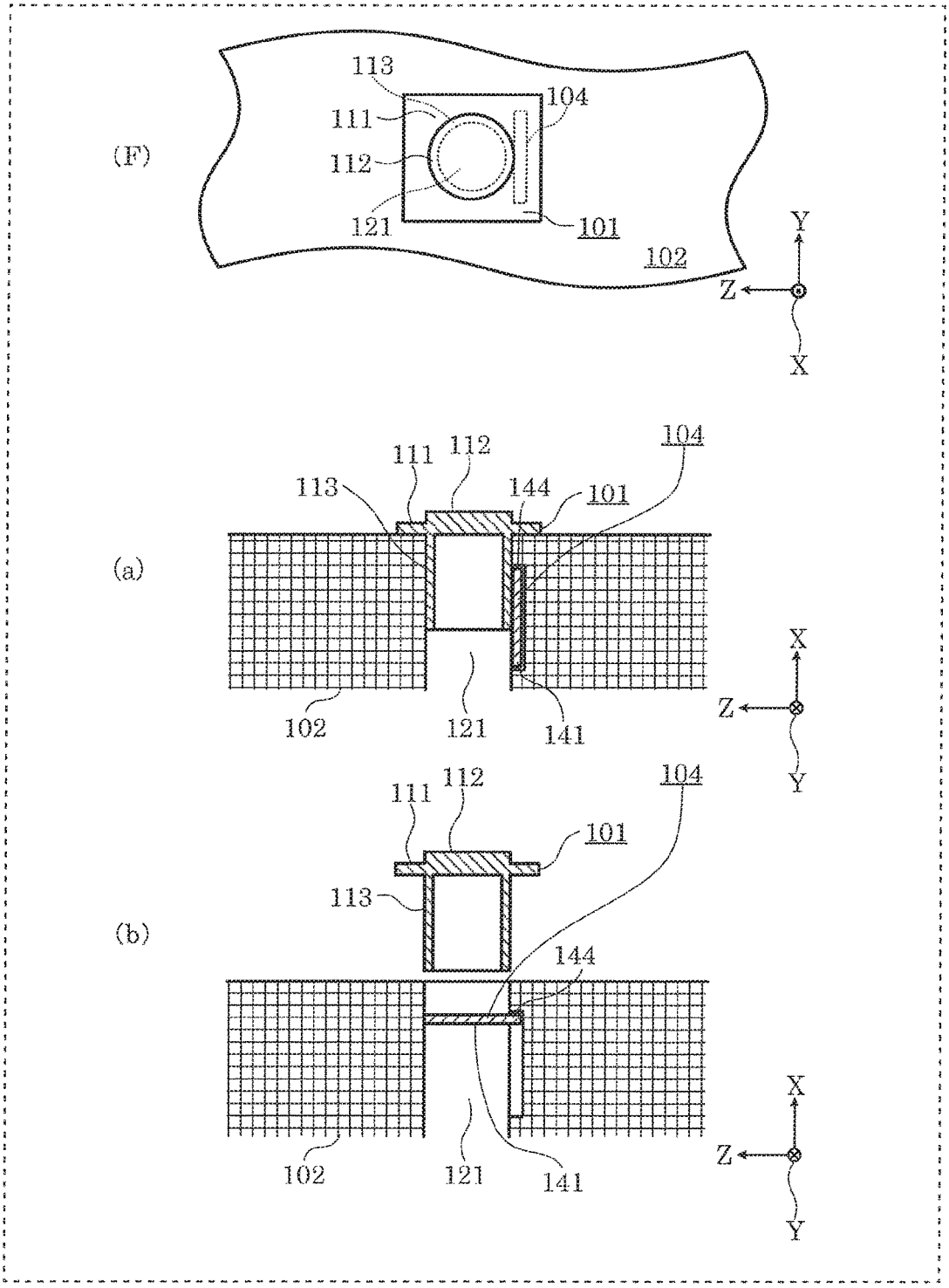
FIG. 10 is a diagram for describing in stages a light emitter replacement operation according to Modification 4.

FIG. 10 is a diagram for describing in stages a light-emitter replacement operation in Modification 4. It should be noted that stage (F) in FIG. 10 is a plan view of the vicinity of light-emitter 101, and stages (a) and (b) in FIG. 10 are cross-sectional views of the vicinity of light-emitter 101 from the side.

As illustrated in the figure, light emitter 101 includes, aside from board 111 and converter 112, insertion portion 113 provided on a side of board 111 which is opposite the side on which converter 112 is disposed.

Insertion portion 113 is a cylindrical portion having an outer diameter that allows seamless insertion into through-hole 121 provided in base 102, and an internal space that allows laser light L to pass through. Furthermore, insertion portion 113 is of such a length that, when inserted into through-hole 121, insertion portion 113 pushes blocking component 141 of light blocker 104 and causes blocking component 141 to rotate.

Through-hole 121 of base 102 also functions as an attachment component for holding insertion portion 113 that has been inserted, and attaching light emitter 101 to base 102.

Light blocker 104 includes blocking component 141, a biasing component (not illustrated), and engaging component 149. Furthermore, blocking component 141 is rotatably attached to base 102 by hinge 144. The biasing component is a spiral spring, and applies force to make blocking component 141 parallel to the surface of base 102.

[Light-Emitter Replacement Operation]

Next, the replacement operation of light-emitter 101 will be described.

As in stage (a) in FIG. 10, light emitter 101 is attached to base 102 by being moved in the optical axis direction (X-axis direction in the figure) of laser light L to insert insertion portion 113 into through-hole 121 which also functions as an attachment component.

In the state where light emitter 101 is inserted in through-hole 121, blocking component 141 is pushed by insertion portion 113 so as to rotate and be positioned at the opening position where through-hole 121 which is the optical path of laser light L is opened.

Next, in stage (b) in FIG. 10, in the state where light emitter 101 is not attached to through-hole 121 of base 102, blocking component 141 is caused by the biasing component to be positioned at the blocking position where through-hole 121 is blocked.

Accordingly, in the process in which light-emitter 101 is to be removed from base 102, light emitter 101 can be safely removed without opening the optical path of laser light L. On the other hand even when inserting insertion portion 113 of light emitter 101 into through-hole 121 in the order of (b) then (a) which is the reverse of the order stated above, light emitter 101 can be safely attached without opening through-hole 121.

Furthermore, in the case of modification 4, blocking component 141 is disposed at a comparatively deep portion of through-hole 121, and thus blocking component 141 does not get touched by a person, and is not rotated unintentionally. Furthermore, since blocking component 141 rotates after the tip of insertion portion 113 is inserted into through-hole 121 and through-hole 121 is covered by light emitter 101, the optical path of laser light L is surely blocked during attachment of light emitter 101. Furthermore, since light emitter 101 is removed after through-hole 121 is blocked by blocking component 141, the optical path can also be surely blocked during removal of light emitter 101.

Although lighting apparatus 100 according to the present disclosure is described based on the foregoing exemplary embodiment, the present disclosure is not limited to the exemplary embodiment.

Although in the foregoing embodiment laser light is introduced inside lighting apparatus 100 by being transmitted from outside lighting apparatus 100 by optical fiber 200, lighting apparatus 100 is not limited to this form. For example, lighting apparatus 100 may include, at an end of case 106, a semiconductor laser element capable of emitting laser light.

Furthermore, the shape of lens 105 is not limited to that in the foregoing embodiment, and can be arbitrarily set based on the desired light distribution.

Forms obtained by various modifications to the exemplary embodiment that can be conceived by a person of skill in the art as well as forms realized by arbitrarily combining structural components and functions in the exemplary embodiment which are within the scope of the essence of the present disclosure are included in the present disclosure.

What is claimed is:

1. A lighting apparatus, comprising:

a base including a through-hole aligned with an optical path of laser light for receiving and transmitting the laser light;

a light emitter which, when irradiated with the laser light transmitted through the through-hole, radiates light by converting a wavelength of the laser light;

an attachment component provided on the base for attachment of the light emitter to the base, the light emitter being removable from the base; and a light blocker which opens the optical path of the laser light by being contacted by the light emitter when the light emitter is attached to the base, and blocks the optical path of the laser light when the light emitter is removed from the base, wherein the light emitter is attached to and removed from the base by being slid along the attachment component, the light blocker includes:

a blocking component that blocks the optical path; and a biasing component that applies force to the blocking component, and the blocking component is positioned at a blocking position where the optical path is blocked, when the light emitter is removed from the attachment component, and is positioned at an opening position where the optical path is opened, when the light emitter is attached to the attachment component.

2. The lighting apparatus according to claim 1, wherein the blocking component is slidably attached to the base, and the biasing component applies the force to the blocking component in a sliding direction of the blocking component to position the blocking component at the blocking position when the light emitter is removed from the attachment component and to position the blocking component in the opening position when the light emitter is attached to the attachment component.

3. The lighting apparatus according to claim 2, wherein the light emitter includes a first board and a converter, the first board including a first portion through which the laser light is transmitted and a second portion through which the laser light is not transmitted, the converter being aligned with the first portion for being irradiated with the laser light and radiating the light, the blocking component includes a second board through which the laser light is not transmitted, and the biasing component is a spring or rubber.

4. The lighting apparatus according to claim 3, wherein, when the optical path is open, the through-hole of the base, the first portion of the first board, and the converter are aligned with the optical path of the laser light, and when the optical path is closed, the through-hole of the base and the second board are aligned with the optical path of the laser light.

5. The lighting apparatus according to claim 4, wherein the first board and the second board have a same shape in a plan view of the lighting apparatus.

6. The lighting apparatus according to claim 4, wherein the converter includes plural types of phosphors which emit light of different colors when irradiated with the laser light.

7. The lighting apparatus according to claim 4, wherein the second board is attached to the attachment component and slidable with respect to the base in a same manner as the first board of the light emitter.

8. The lighting apparatus according to claim 7, wherein the attachment component includes a pair of grooves in the base for sandwiching the first board of the light emitter and the second board of the light blocker.

9. The lighting apparatus according to claim 2, wherein the blocking component is disposed closer to a laser light entry side of the base than the light emitter.

10. The lighting apparatus according to claim 9, wherein the blocking component includes a lever which protrudes beyond a surface of the base, and the light emitter contacts the lever and extends the biasing component when the light emitter is attached to the attachment component to open the optical path of the laser light.

11. The lighting apparatus according to claim 10, wherein the light emitter includes a first board and a converter, the first board including a first portion through which the laser light is transmitted and a second portion through which the laser light is not transmitted, the converter being aligned with the first portion for being irradiated with the laser light and radiating the light, the blocking component includes a second board through which the laser light is not transmitted, the second board including a transmission hole through which the laser light is transmitted, and the biasing component is a spring or rubber.

12. The lighting apparatus according to claim 11, wherein, when the optical path is open, the through-hole of the base, the transmission hole of the second board, the first portion of the first board, and the converter are aligned with the optical path of the laser light, and when the optical path is closed, the through-hole of the base and the second board are aligned with the optical path of the laser light.

13. The lighting apparatus according to claim 12, wherein the attachment component includes a groove which extends into the base from a surface of the through-hole in the base, and the second board is within a periphery of the base, transverse to the through-hole in the base, and extends into the groove.

14. The lighting apparatus according to claim 1, wherein the blocking component is rotatably attached to the base, and the light blocker further includes an engaging component that positions the blocking component at the blocking position when the light emitter is not attached to the attachment component, and engages with the light emitter to cause the blocking component to rotate to the opening position when the light emitter is attached to the attaching component.

15. The lighting apparatus according to claim 14, wherein the light emitter includes a first board and a converter, the first board including a first portion through which the laser light is transmitted and a second portion through which the laser light is not transmitted, the converter being aligned with the first portion for being irradiated with the laser light and radiating the light, the blocking component includes a second board through which the laser light is not transmitted, the second board including a transmission hole through which the laser light is transmitted, the biasing component is a spring or rubber, and the attachment component is a hinge.

16. The lighting apparatus according to claim 15, wherein, when the optical path is open, the second board is orthogonal to the through-hole of the base with the through-hole of the base, the transmission hole of the second board, the first portion of the first board, and the converter being aligned with the optical path of the laser light, and when the optical path is closed, the second board is not orthogonal to the through-hole of the base with the through-hole of the base and the second board being aligned with the optical path of the laser light.

17. The lighting apparatus according to claim 1, wherein the light emitter is attached to and removed from the base by being moved in an optical axis direction of the laser light with respect to the attachment component, and includes an insertion portion that is inserted into the base, the light blocker includes:

a blocking component that blocks the optical path; and a biasing component that applies force to the blocking component, and the blocking component is positioned at a blocking position where the optical path is blocked, when the light emitter is removed from the attachment component, and, by being pressed by the insertion portion, is positioned at an opening position where the optical path is opened, when the light emitter is attached to the attachment component.

18. A lighting apparatus comprising:

a base including a through-hole aligned with an optical path of laser light for receiving and transmitting the laser light;

a light emitter which, when irradiated with the laser light transmitted through the through-hole, radiates light by converting a wavelength of the laser light;

an attachment component provided on the base for attachment of the light emitter to the base, the light emitter being removable from the base; and a light blocker which opens the optical path of the laser light by being contacted by the light emitter when the light emitter is attached to the base, and blocks the optical path of the laser light when the light emitter is removed from the base, wherein the light emitter is attached to and removed from the base by being moved in an optical axis direction of the laser light with respect to the attachment component, and includes an insertion portion that is inserted into the base, the light blocker includes:

a blocking component that blocks the optical path; and a biasing component that applies force to the blocking component, the blocking component is positioned at a blocking position where the optical path is blocked, when the light emitter is removed from the attachment component, and, by being pressed by the insertion portion, is positioned at an opening position where the optical path is opened, when the light emitter is attached to the attachment component, the light emitter includes a first board and a converter, the first board including a first portion through which the laser light is transmitted and a second portion through which the laser light is not transmitted, the converter being aligned with the first portion for being irradiated with the laser light and radiating the light, the blocking component includes a second board, the biasing component is a spring or rubber, and the attachment component is a hinge.

19. A housing for a lighting apparatus, the housing comprising:

a case including a first opening and a second opening, the first opening configured to receive laser light, the second opening being aligned along an optical path with the first opening for emitting light;

a base fixed to an inner circumferential surface of the case, the base including a through-hole aligned with the optical path for receiving and transmitting the laser light;

an attachment component provided on the base for receiving and releasing a light emitter; and a light blocker configured to open the optical path between the first opening and the second opening of the case when the attachment component receives the light emitter, and block the optical path between the first opening and the second opening when the attachment component releases the light emitter, wherein the light emitter is attached to and removed from the base by being slid along the attachment component, the light blocker includes:

a blocking component that blocks the optical path; and a biasing component that applies force to the blocking component, and the blocking component is positioned at a blocking position where the optical path is blocked, when the light emitter is removed from the attachment component, and is positioned at an opening position where the optical path is opened, when the light emitter is attached to the attachment component.

* * * * *